US007029540B2

(12) United States Patent
Tachisato et al.

(10) Patent No.: US 7,029,540 B2
(45) Date of Patent: Apr. 18, 2006

(54) METHOD OF GAS CARBURIZING

(75) Inventors: Showa Tachisato, Yamatokoriyama (JP); Tomoyuki Ishibashi, Soraku-gun (JP); Shohei Tsuji, Nabari (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 274 days.

(21) Appl. No.: 10/768,810

(22) Filed: Jan. 30, 2004

(65) Prior Publication Data

US 2005/0000598 A1 Jan. 6, 2005

(30) Foreign Application Priority Data

Jul. 3, 2003 (JP) ..... PCT/JP03/08454

(51) Int. Cl.
*C23C 8/22* (2006.01)

(52) U.S. Cl. ..... 148/225; 148/223; 148/233

(58) Field of Classification Search ..... 148/206, 148/223, 225, 233
See application file for complete search history.

(56) References Cited

FOREIGN PATENT DOCUMENTS

| | | | |
|---|---|---|---|
| JP | 6-192815 | | 7/1994 |
| JP | 9-59756 | | 3/1997 |
| JP | 09-059756 | * | 3/1997 |
| JP | 11-036060 | | 2/1999 |
| JP | 11-200009 | * | 7/1999 |
| JP | 2001-81543 | | 3/2001 |
| JP | 2001-214255 | | 8/2001 |
| WO | WO- 03/104515 | | 12/2003 |
| WO | WO- 03/104516 | | 12/2003 |

OTHER PUBLICATIONS

Yu'ev et al., Investigation of High-Temperature Carburizing of Steel in Solid Carburizer with High-Frequency Heating, 1959, Metallovediei Term. Obrabotka Metallov, Aug., pp. 32-38.*

* cited by examiner

*Primary Examiner*—Roy King
*Assistant Examiner*—Michael P. Alexander
(74) *Attorney, Agent, or Firm*—Jordan and Hamburg LLP

(57) ABSTRACT

In a first process of a method of gas carburizing, a steel treatment object in a carburizing atmosphere containing carburizing gas is heated to an initial set temperature which is not higher than a peritectic point at which δ iron and a liquid phase transform into γ iron and not less than a eutectic point at which the liquid phase transforms into γ iron and cementite, such that the surface carbon concentration thereof does not exceed a solid solubility limit. In a second process following the first process, the carburizing temperature is gradually decreased from the initial set temperature such that the surface carbon concentration of the treatment object increases without exceeding the solid solubility limit, and such that the carburized depth of the treatment object increases.

15 Claims, 5 Drawing Sheets

METHOD OF GAS CARBURIZING

TECHNICAL FIELD

The present invention relates to a method of gas carburizing for improving metallic components in the automotive industry and industrial machinery industry, for example.

BACKGROUND ART

Conventionally, when gas carburizing is carried out on a steel treatment object, the carburizing temperature has been set below the eutectic point at which the liquid phase transforms into γ iron and cementite (for example, the temperature at point C in the iron-carbon equilibrium diagram shown in FIG. 1, which is 1147° C.). However, when the carburizing temperature is limited to below the eutectic point, the diffusion rate of carbon atoms in the austenite slows, and since a large amount of time is required to increase the carburized depth from the surface of the treatment object, the carburizing time cannot be reduced.

In order to achieve a reduction in the carburizing time, increasing the carburizing temperature to or above the eutectic point has been considered to increase the diffusion rate of carbon atoms in the austenite.

However, even when the carburizing temperature is increased to or above the eutectic point, a large amount of time is required for the surface carbon concentration of the treatment object to reach the target value, and hence it is difficult to further reduce the carburizing time.

An object of the present invention is to provide a method of gas carburizing which is capable of solving the conventional problem described above.

DISCLOSURE OF INVENTION

When the carburizing temperature and carburizing gas concentration are constant, long time is required for the carburized depth to reach its target value if the carburizing temperature is low, whereas if the carburizing temperature rises excessively, the surface carbon concentration of the treatment object exceeds a solid solubility limit before the carburized depth reaches its target value, and as a result the treatment object melts. Hence when the carburizing temperature land carburizing gas concentration are constant, it is difficult to shorten the carburizing time below the time required for the surface carbon concentration of the treatment object to reach a solid solubility limit (for example, to reach the JE line in FIG. 1). In response to this problem, the present invention achieves a reduction in the time required for carburizing processing by means of a novel relationship between the carburizing temperature, the carburizing time, and the surface carbon concentration of the treatment object.

A method of gas carburizing according to the present invention is characterized in that it comprises a first process in which a steel treatment object in a carburizing atmosphere containing carburizing gas is heated to an initial set temperature which is not higher than a peritectic point at which δ iron and a liquid phase transform into γ iron and not less than a eutectic point at which the liquid phase transforms into γ iron and cementite, such that the surface carbon concentration of the treatment object does not exceed a solid solubility limit, and a second process following the first process in which the carburizing temperature is gradually decreased from the initial set temperature such that the surface carbon concentration of the treatment object increases without exceeding the solid solubility limit, and the carburized depth of the treatment object increases. According to the present invention, in the first process the surface carbon concentration of the treatment object can be increased to the vicinity of the solid solubility limit in a short amount of time, and in the second process the surface carbon concentration of the treatment object can be increased without melting the treatment object and also the carburized depth can be increased in a short amount of time.

It is preferable that a lower limit of the temperature increase rate of the treatment object required to maintain the surface carbon concentration of the treatment object within the solid solubility limit while maintaining the partial pressure of carburizing gas at a constant value is predetermined, and that the temperature of the treatment object is increased at a rate of at least the predetermined lower limit in the first process.

If the temperature increase rate during heating of the treatment object to the initial set temperature is low, decomposition of the carburizing gas advances throughout the temperature increasing process, with the result that the surface carbon concentration of the treatment object is increased and the initial set temperature which is set not so as to melt the treatment object should be lowered. Hence a lower limit of the temperature increase rate of the treatment object during heating of the treatment object to the initial set temperature without melting the treatment object is predetermined, whereupon the temperature of the treatment object is increased at a rate of at least the predetermined lower limit, with the result that the initial set temperature can be prevented from being lowered and the carburizing time can be reduced.

The carburizing temperature is preferably caused to begin decreasing in the second process immediately after the treatment object is reached to the initial set temperature in the first process.

The surface carbon concentration exceeds the solid solubility limit if the treatment object is held at the initial set temperature, and hence the carburizing temperature is caused to begin decreasing immediately after the treatment object is reached to the initial set temperature to start the second process, with the result that the carburizing time can be reduced without melting the treatment object.

In the second process, it is preferable that a lower limit of the carburizing temperature decrease rate required to maintain the surface carbon concentration of the treatment object within the solid solubility limit while maintaining the partial pressure of carburizing gas at a constant value is predetermined, and that the carburizing temperature is caused to decrease at a rate of at least the predetermined lower limit. In this case, the lower limit of the decrease rate is preferably predetermined such that the surface carbon concentration of the treatment object increases along a boundary line (the JE line in FIG. 1) between a region comprising γ iron and a region comprising γ iron and a liquid phase in an iron-carbon equilibrium diagram in the second process.

At a temperature not higher than the peritectic point and not less than the eutectic point, as shown by the JE line in FIG. 1, for example, the solid solubility limit of carbon on the surface of the treatment object increases as the carburizing temperature decreases. In this case, if the carburizing temperature decrease rate is too low, the surface carbon concentration of the treatment object exceeds the solid solubility limit. Therefore, by predetermining a lower limit of the carburizing temperature decrease rate required to maintain the surface carbon concentration of the treatment object within the solid solubility limit and causing the carburizing temperature to decrease at a rate of at least the predetermined lower limit, the carburized depth can be increased in a short amount of time without melting the treatment object. In particular, by predetermining the decrease rate lower limit such that the surface carbon concentration of the treatment object increases along the JE line in FIG. 1, and causing the carburizing temperature to decrease at a rate corresponding to the predetermined lower limit, the carburizing time can be reduced to the greatest extent possible.

To further reduce the carburizing time, the initial set temperature and the carburizing temperature decrease rate are preferably set such that the carburizing temperature is not less than the eutectic point when the carburized depth of the treatment object reaches a target value in the second process.

It is preferable that the partial pressure of carburizing gas in the first process and the partial pressure of carburizing gas in the second process are set at equal constant values. In so doing, the first process and second process can be performed in series, and thus carburization processing can be shortened and automated.

According to the present invention, energy and gas consumption required for gas carburizing can be reduced by shortening the carburizing time.

BEST MODE FOR CARRYING OUT THE INVENTION

Figure 2:
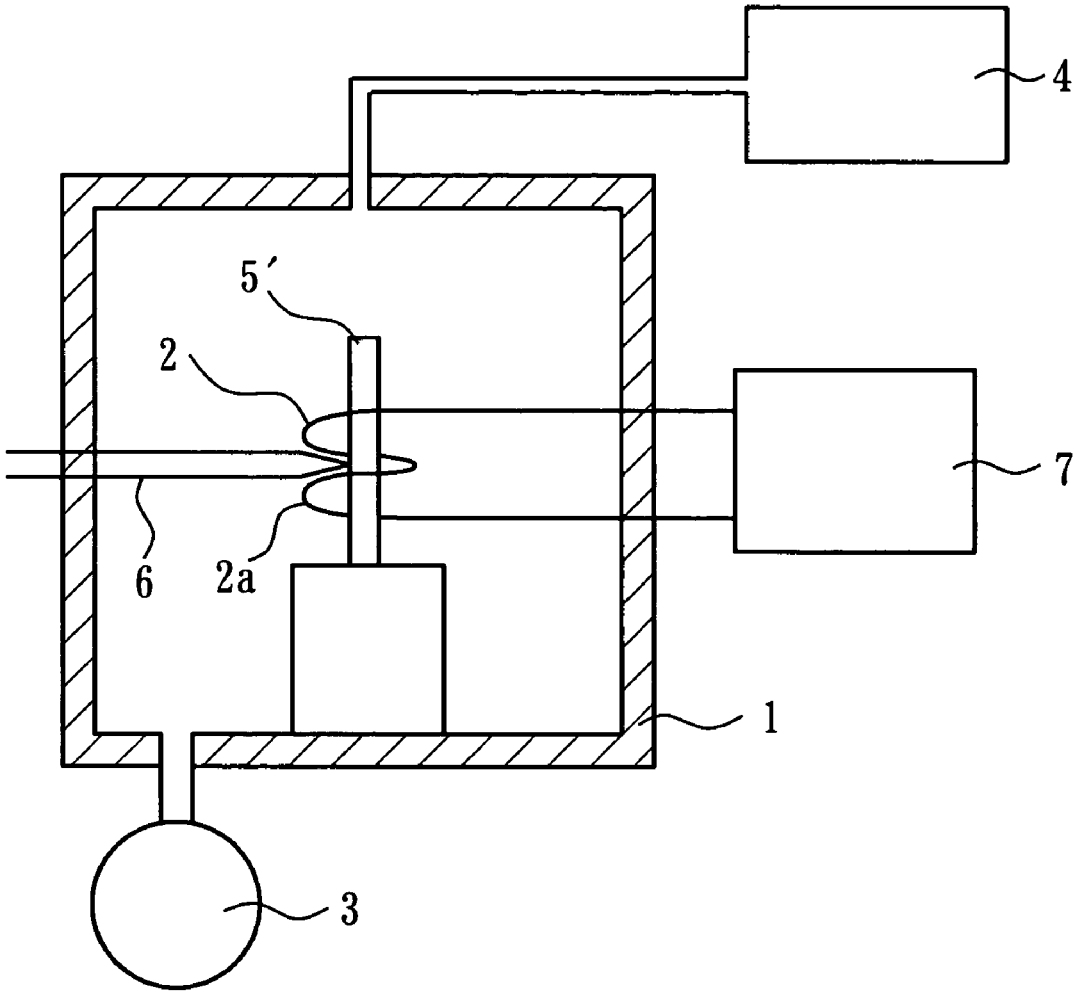
FIG. 2 is a view showing a state in which a sample of a treatment object is heated by a gas carburizing apparatus of an embodiment of the present invention.

FIG. 2 shows a gas carburizing apparatus used in an embodiment of the present invention. The gas carburizing apparatus comprises a vacuum container 1, a heating device 2, a vacuum pump 3 for reducing the pressure inside the vacuum container 1, and a gas source 4 for supplying gas for carburizing atmosphere into the vacuum container 1. In this embodiment, the heating device 2 performs induction heating inside the vacuum container 1 using a coil 2*a* connected to a power source 7. The output from the power source 7 to the coil 2*a* is variable.

Prior to gas carburizing of a steel treatment object, a sample 5' of the steel treatment object is gas carburized. In order to perform this gas carburizing, a thermocouple 6 is welded to the surface of the sample 5' set to the heating device 2 as a sensor for detecting temperature. The temperature detection means are not limited to a thermocouple. Then, the pressure inside the vacuum container 1 is reduced by evacuating the vacuum container 1 with the vacuum pump 3, at this time, the pressure inside the vacuum container 1 is preferably about 27 Pa or less. Following this pressure reduction, the gas for carburizing atmosphere is introduced into the vacuum container 1 from the gas source 4. As a result, the interior of the vacuum container 1 is filled with a carburizing atmosphere, and the total pressure of the carburizing atmosphere is increased. For example, the pressure of the carburizing atmosphere inside the vacuum container 1 is increased to approximately 80 kPa. The gas for carburizing atmosphere in this embodiment is composed of a carburizing gas and a dilute gas. There are no particular limitations on the type of carburizing gas and dilute gas. In this embodiment, the carburizing gas is methane gas and the dilute gas is nitrogen gas. Using a hydrocarbon gas as the carburizing gas enables non-oxidizing carburization to be realized. The carburizing gas is not limited to a hydrocarbon gas. The carburizing atmosphere may even be partially or completely constituted by the carburizing gas.

Figure 3:
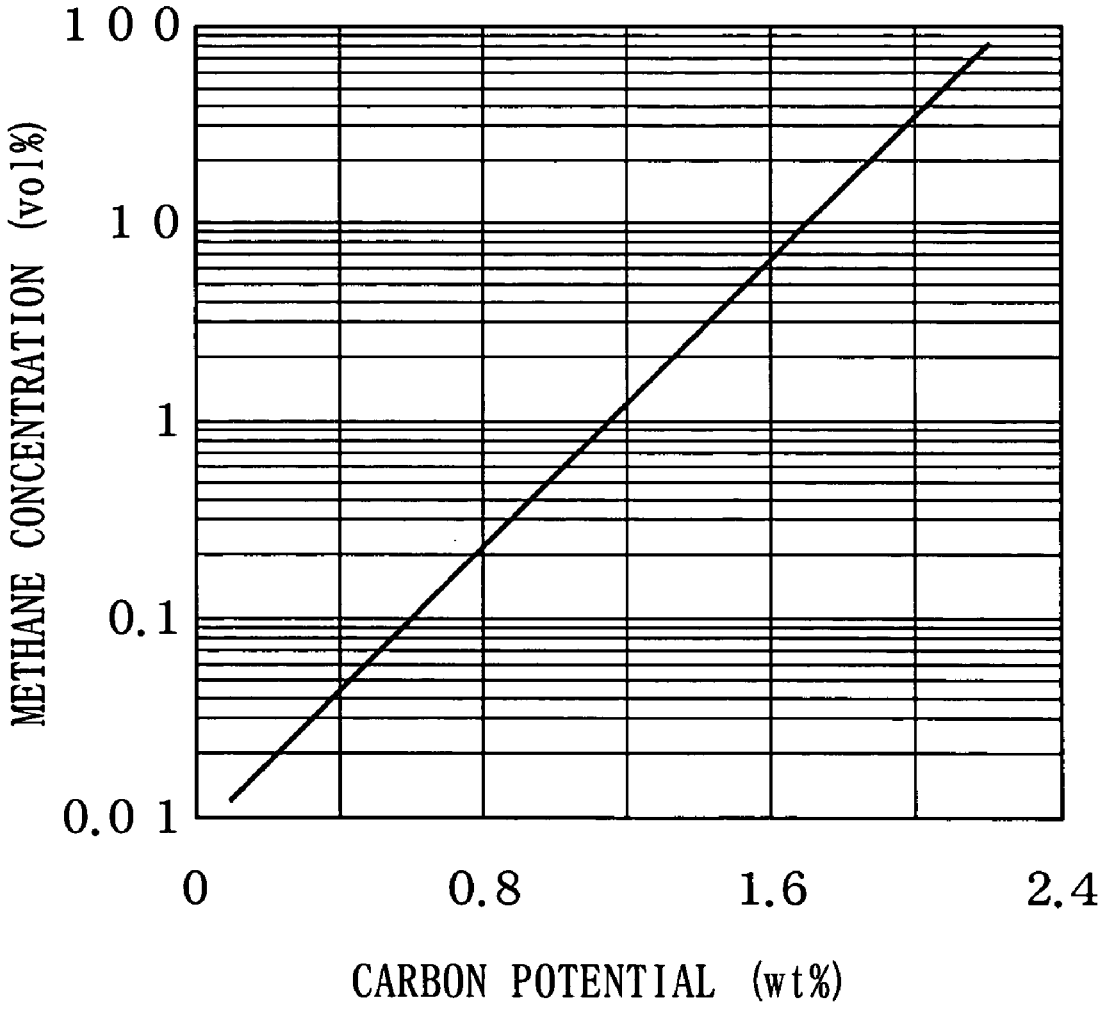
FIG. 3 is a diagram illustrating the relationship between the carbon potential and concentration of carburizing gas.

When the total pressure of the carburizing atmosphere inside the vacuum container 1 is maintained at a constant value, the gas for carburizing atmosphere is supplied from the gas source 4 into the vacuum container 1 at a constant flow rate, and the carburizing atmosphere is released by the vacuum pump 3 at a constant flow rate. As a result, the gas for carburizing atmosphere flows inside the vacuum container 1 at a constant flow rate of 0.5 L/min, for example, and the total pressure of the carburizing atmosphere is maintained at approximately 80 kPa, for example. In other words, a carburizing atmosphere containing a carburizing gas at a constant partial pressure flows inside the vacuum container 1. The partial pressure of the carburizing gas is a value obtained by multiplying the total pressure of the carburizing atmosphere inside the vacuum container 1 by a molar fraction or volume percent of the carburizing gas, and this value corresponds to the carburizing gas concentration. By varying the total pressure of the carburizing atmosphere inside the vacuum container 1 or the ratio between the flow rates of the carburizing gas and the dilute gas, the carburizing gas concentration (volume percent) corresponding to the carbon potential of the carburizing gas at a certain temperature can be varied. The concentration corresponding to the partial pressure of the carburizing gas can be determined in accordance with a target carbon concentration of the treatment object. The relationship between the carbon potential of the carburizing gas and the carburizing gas concentration (volume percent) at a certain temperature can be predetermined through an experiment due to the fact that the surface carbon concentration of the treatment object matches the carbon potential at the certain temperature if carburizing is performed over a long period of time at a constant carburizing gas concentration. FIG. 3 shows an example of a relationship predetermined through experiments between the carburizing gas concentration (volume percent) and the carbon potential (weight percent) at 1300° C.

The sample 5' is heated to an initial set temperature by the heating device 2 while the partial pressure of the carburizing gas is maintained at a constant value. This initial set temperature is set to be not higher than the peritectic point temperature at which δ iron and the liquid phase are transformed into γ iron, and not less than the eutectic point temperature at which the liquid phase is transformed into γ iron and cementite, and can be adjusted by varying the output of the heating device 2 to the coil 2*a*. At this time, a lower limit of the temperature increase rate of the sample 5' required to maintain the surface carbon concentration of the sample 5' within the solid solubility limit is determined. More specifically, if the temperature increase rate during heating of the sample 5' to the initial set temperature is low, decomposition of the carburizing gas advances throughout the increasing process, causing the surface carbon concentration of the sample 5' to increase beyond the solid solubility limit, whereupon melting begins. The lower limit of the temperature increase rate is determined so that such melting does not occur. For example, since the aforementioned peritectic point is 1494° C., the initial set temperature is set to less than 1494° C., and then the sample 5' is heated to the initial set temperature while maintaining the carburizing gas concentration at 3 volume percent, for example, and the temperature increase rate directly before the surface of the sample 5' melts is determined. If the initial set temperature is too high, the surface of the sample 5' melts even if the temperature increase rate is increased, and hence the lower limit of the temperature increase rate is determined for an initial set temperature at which such melting does not occur. The initial set temperature is preferably set as high as possible in order to reduce the carburizing time.

Figure 1:
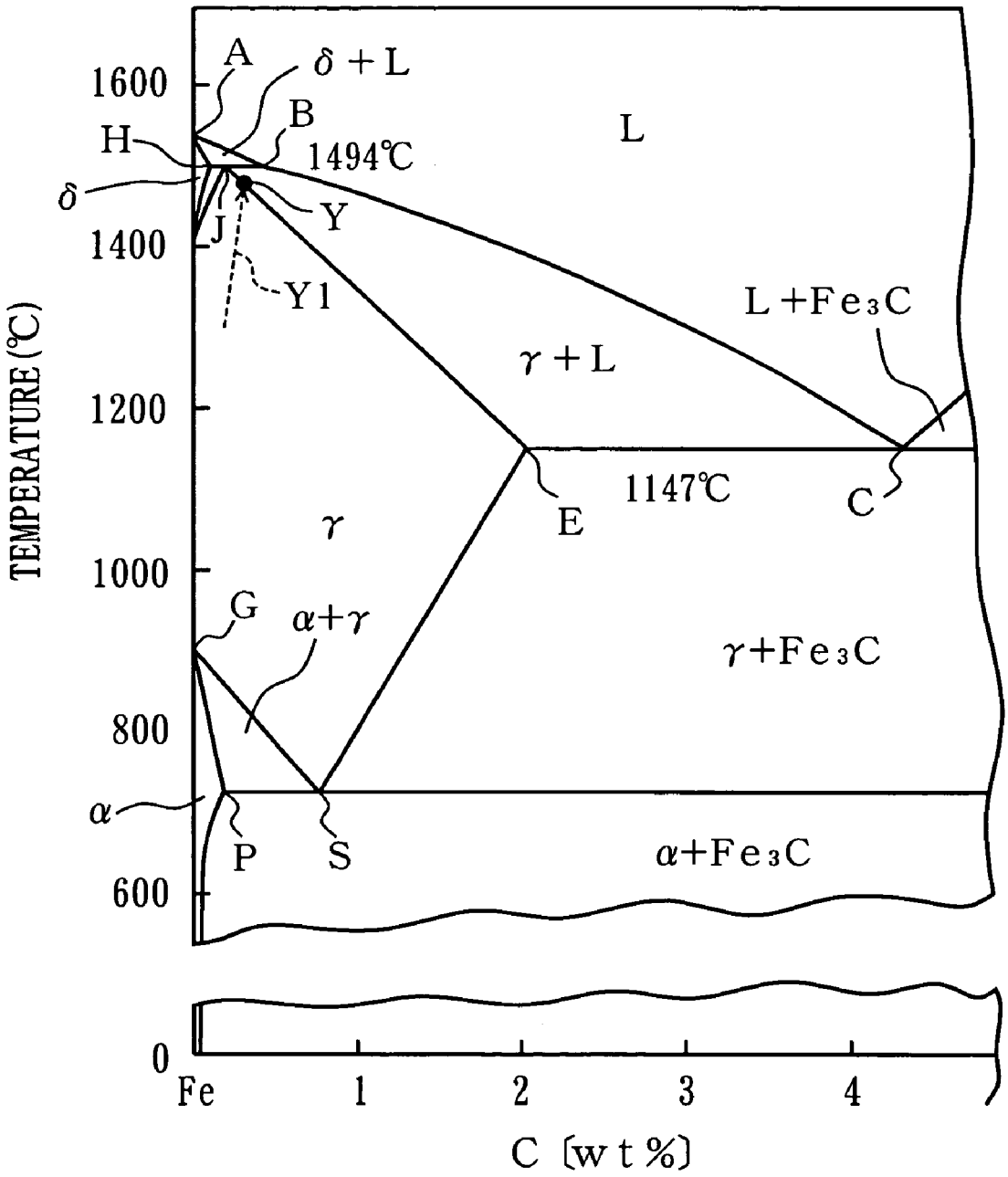
FIG. 1 is an iron-carbon equilibrium diagram.
Figure 4:
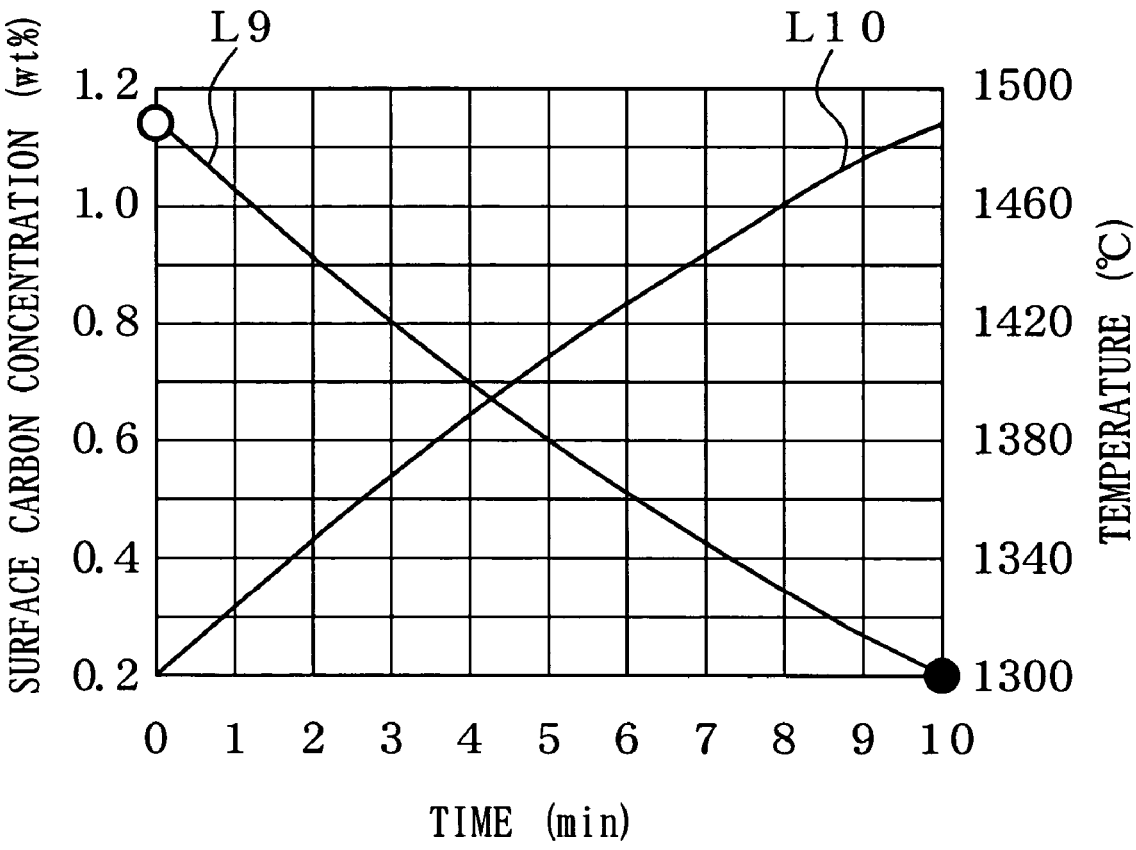
FIG. 4 is a diagram illustrating the relationship between surface carbon concentration, carburizing temperature, and time for altering the surface carbon concentration of the treatment object according to variation in the solid solubility limit in the embodiment of the present invention.

As shown by the JE line in FIG. 1, that is, the boundary line between the region composed of γ iron and the region composed of γ iron and the liquid phase in the iron-carbon equilibrium diagram, the solid solubility limit of carbon on the surface of the sample 5' increases as the carburizing temperature decreases. Hence when carburization of the sample 5' is caused to proceed at a carburizing temperature not higher than the peritectic point and not less than the eutectic point, the lower limit of a carburizing temperature decrease rate required to maintain the surface carbon concentration of the sample 5' within the solid solubility limit while maintaining the partial pressure of the carburizing gas at a constant value can be determined. In this embodiment, the lower limit of the decrease rate is determined such that the surface carbon concentration of the sample 5' increases along the JE line in FIG. 1. When the carburizing gas concentration is 3 volume percent, for example, the carburizing temperature decreases with time as shown by the solid line L9 in FIG. 4, and accordingly, the surface carbon concentration of the sample 5' increases with time as shown by the solid line L10, in which this increase in surface carbon concentration corresponds to variation in the solid solubility limit of carbon in the surface of the sample 5' due to the decrease in the carburizing temperature. Hence the lower limit of the carburizing temperature decrease rate is determined from the relationship between the carburizing temperature and time shown by the solid line L9 in FIG. 4.

As described above, when the sample 5' is heated to the initial set temperature while maintaining the partial pressure of the carburizing gas at a constant value, the lower limit of the temperature increase rate required to maintain the surface carbon concentration within the solid solubility limit is determined, and when carburization is caused to proceed while maintaining the partial pressure of the carburizing gas at a constant value, the lower limit of the carburizing temperature decrease rate required to maintain the surface carbon concentration of the sample 5' within the solid solubility limit is determined, and then gas carburization of the steel treatment object is performed with the above-described gas carburizing apparatus.

Figure 5:
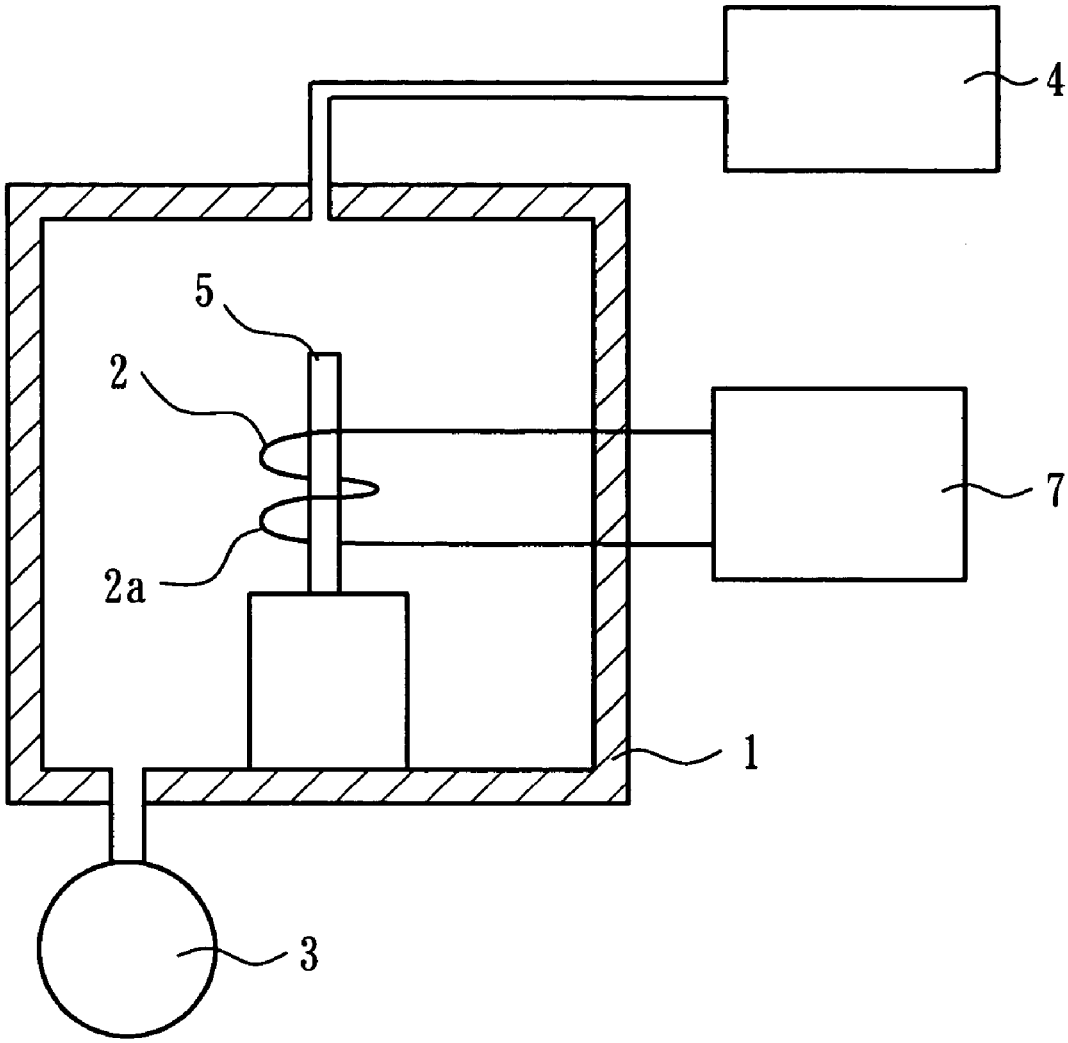
FIG. 5 is a view showing a state in which the treatment object is heated by the gas carburizing apparatus of the embodiment of the present invention.

Carburization of the treatment object can be performed in a similar manner to carburization of the sample 5'. To be more precise, as shown in FIG. 5, the steel treatment object 5 is set to the heating device 2, the vacuum container 1 is evacuated by the vacuum pump 3, and gas for carburizing atmosphere is introduced into the vacuum container 1 from the gas source 4 to increase the pressure of the carburizing atmosphere to a set pressure, the gas for carburizing atmosphere is supplied from the gas source 4 into the vacuum container 1 at a constant flow rate, and the gas for carburizing atmosphere is discharged by the vacuum pump 3 at a constant flow rate. As a result, the partial pressure of the carburizing gas inside the vacuum container 1 is set to a constant value. Next, a first process is performed in which the treatment object 5 is heated to the initial set temperature which is not higher than the peritectic point at which δ iron and the liquid phase transform into γ iron and not less than the eutectic point at which the liquid phase transforms into γ iron and cementite by the heating device 2. In this first process, the temperature of the treatment object 5 is increased at a rate of at least the lower limit of the temperature increase rate that was predetermined by using the sample 5' so that the surface carbon concentration of the steel treatment object 5 does not exceed the solid solubility limit. In the first process, for example, the initial value of the surface carbon concentration of the treatment object 5 is 0.2 weight percent, the carburizing gas (methane gas) concentration is set at 3 volume percent, the initial set temperature is set at 1470° C., and the temperature increase rate of the treatment object 5 is set at 45 seconds from normal temperature to 1470° C. Thus the surface carbon concentration of the treatment object 5 varies as shown by the broken arrow Y1 in FIG. 1 so as to reach the vicinity of a point Y on the JE line, which indicates a solid solubility limit, in a short amount of time.

Following the first process described above, a second process is performed in which the carburizing temperature is caused to decrease gradually from the initial set temperature, thereby increasing the surface carbon concentration of the treatment object 5 without exceeding the solid solubility limit and also increasing the carburizing depth of the treatment object 5. The carburizing temperature in the second process preferably begins to decrease immediately after the treatment object reaches the initial set temperature in the first process with no substantial delay. In the second process, the carburizing temperature is caused to decrease at a rate of at least the lower limit of the carburizing temperature decrease rate that was predetermined using the sample 5' so that the surface carbon concentration of the steel treatment object 5 can be maintained within the solid solubility limit while maintaining the partial pressure of the carburizing gas at a constant value. The initial set temperature and the decrease rate of the carburizing temperature are also set such that the carburizing temperature is not less than the eutectic point when the carburizing depth of the treatment object 5 reaches the target value. Furthermore, the partial pressure of the carburizing gas in the first process and the carburizing gas concentration in the second process are set at equal constant values. In the second process, the carburizing temperature decrease rate of the treatment object 5 is set at 20° C. per minute, for example.

The present invention is not limited to the embodiment described above, and various modifications can be implemented within the scope of the present invention.

What is claimed is:

1. A method of gas carburizing comprising:

a first process in which a steel treatment object in a carburizing atmosphere containing carburizing gas is heated to an initial set temperature which is not higher than a peritectic point at which δ iron and a liquid phase transform into γ iron and not less than a eutectic point at which the liquid phase transforms into γ iron and cementite, such that the surface carbon concentration of said treatment object does not exceed a solid solubility limit; and a second process following the first process in which the carburizing temperature is gradually decreased from said initial set temperature such that the surface carbon concentration of said treatment object increases without exceeding the solid solubility limit, and the carburized depth of said treatment object increases.

2. The method of gas carburizing according to claim 1, wherein a lower limit of the temperature increase rate of said treatment object required to maintain the surface carbon concentration of said treatment object within the solid solubility limit while maintaining the partial pressure of carburizing gas at a constant value is predetermined, and the temperature of said treatment object is increased at a rate of at least the predetermined lower limit in said first process.

3. The method of gas carburizing according to claim 1, wherein the carburizing temperature is caused to begin decreasing in said second process immediately after said treatment object is reached to said initial set temperature in said first process.

4. The method of gas carburizing according to claim 2, wherein the carburizing temperature is caused to begin decreasing in said second process immediately after said treatment object is reached to said initial set temperature in said first process.

5. The method of gas carburizing according to any of claims 1 through 4, wherein a lower limit of the carburizing temperature decrease rate required to maintain the surface carbon concentration of said treatment object within the solid solubility limit while maintaining the partial pressure of carburizing gas at a constant value is predetermined, and the carburizing temperature is caused to decrease at a rate of at least the predetermined lower limit in said second process.

6. The method of gas carburizing according to claim 5, wherein said lower limit of the decrease rate is predetermined such that the surface carbon concentration of said treatment object increases along a boundary line between a region comprising γ iron and a region comprising γ iron and a liquid phase in an iron-carbon equilibrium diagram in said second process.

7. The method of gas carburizing according to any of claims 1 through 4, wherein said initial set temperature and the carburizing temperature decrease rate are set such that the carburizing temperature is not less than said eutectic point when the carburized depth of said treatment object reaches a target value in said second process.

8. The method of gas carburizing according to claim 5, wherein said initial set temperature and the carburizing temperature decrease rate are set such that the carburizing temperature is not less than said eutectic point when the carburized depth of said treatment object reaches a target value in said second process.

9. The method of gas carburizing according to claim 6, wherein said initial set temperature and the carburizing temperature decrease rate are set such that the carburizing temperature is not less than said eutectic point when the carburized depth of said treatment object reaches a target value in said second process.

10. The method of gas carburizing according to any of claims 1 through 4, wherein the partial pressure of carburizing gas in said first process and the partial pressure of carburizing gas in said second process are set at equal constant values.

11. The method of gas carburizing according to claim 5, wherein the partial pressure of carburizing gas in said first process and the partial pressure of carburizing gas in said second process are set at equal constant values.

12. The method of gas carburizing according to claim 6, wherein the partial pressure of carburizing gas in said first process and the partial pressure of carburizing gas in said second process are set at equal constant values.

13. The method of gas carburizing according to claim 7, wherein the partial pressure of carburizing gas in said first process and the partial pressure of carburizing gas in said second process are set at equal constant values.

14. The method of gas carburizing according to claim 8, wherein the partial pressure of carburizing gas in said first process and the partial pressure of carburizing gas in said second process are set at equal constant values.

15. The method of gas carburizing according to claim 9, wherein the partial pressure of carburizing gas in said first process and the partial pressure of carburizing gas in said second process are set at equal constant values.

* * * * *